US005500573A

United States Patent [19]

Schulz

[11] Patent Number: 5,500,573

[45] Date of Patent: Mar. 19, 1996

[54] DIMMER CIRCUIT FOR GAS DISCHARGE LAMPS HAVING ELECTRONIC BALLASTS

[75] Inventor: Reinhard Schulz, Immenstaad, Germany

[73] Assignee: Hilite Lighting and Electronics Ltd., Mosta, Malta

[21] Appl. No.: 392,502

[22] Filed: Feb. 23, 1995

[30] Foreign Application Priority Data

Feb. 24, 1994 [DE] Germany ..... 44 06 000.9

[51] Int. Cl.[6] ..... H05B 37/00

[52] U.S. Cl. ..... 315/247; 315/308; 315/DIG. 4

[58] Field of Search ..... 315/291, DIG. 4, 315/294, 307, 308, 247

[56] References Cited

U.S. PATENT DOCUMENTS 5,107,184 4/1992 Hu et al. ..... 315/291

FOREIGN PATENT DOCUMENTS

0439240A2 7/1991 European Pat. Off. .
3235197 4/1983 Germany .
3232592 3/1984 Germany .
3445817 6/1986 Germany .
3639116 5/1988 Germany .
4010435 10/1991 Germany .
4128314 3/1993 Germany .
WO94/03033 2/1994 WIPO .

*Primary Examiner*—Robert J. Pascal
*Assistant Examiner*—Reginald A. Ratliff
*Attorney, Agent, or Firm*—Jacobson, Price, Holman & Stern

[57] ABSTRACT

A dimmer circuit for gas discharge lamps, having an electronic ballast equipped with a first converter circuit which first transforms an applied voltage by means of switching transistors into a first high-frequency alternating voltage. This first high-frequency alternating voltage is fed indirectly or directly to the gas discharge lamp. The dimmer circuit also includes a second converter circuit connected upstream. The second converter circuit is arranged so as to transform an input voltage into a second high-frequency alternating voltage and is also arranged so as to rectify the second high-frequency alternating voltage to produce a rectified output voltage. After rectification, the rectified output voltage is fed to the first converter circuit as the above-mentioned applied voltage. The second converter circuit contains switching means which, operated manually or by remote control, influence the magnitude of the rectified output voltage from the second converter circuit.

14 Claims, 2 Drawing Sheets

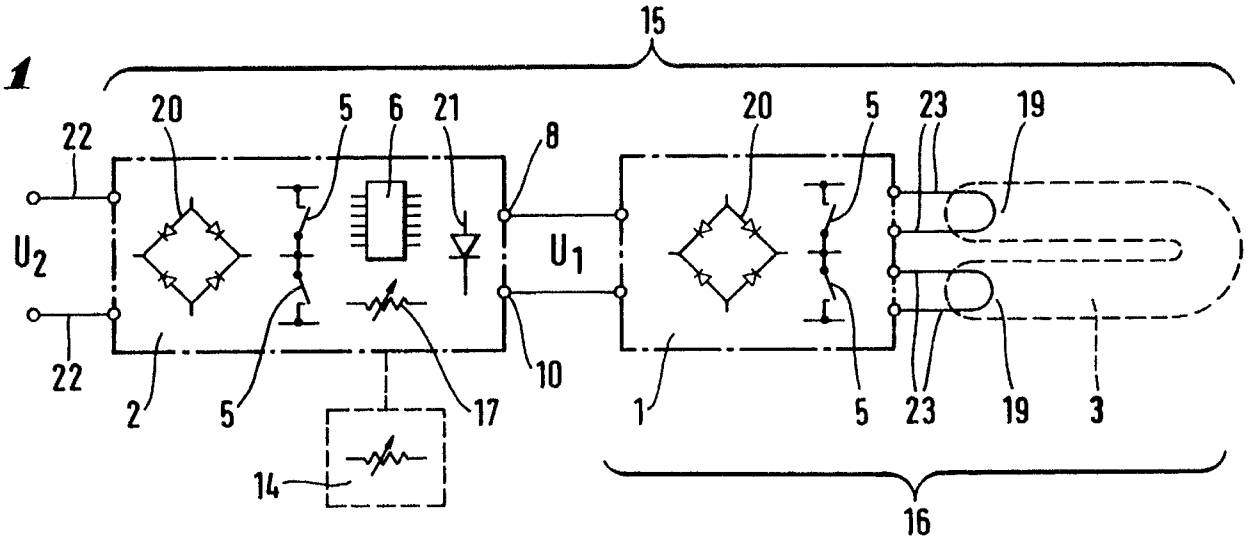
Fig. 1
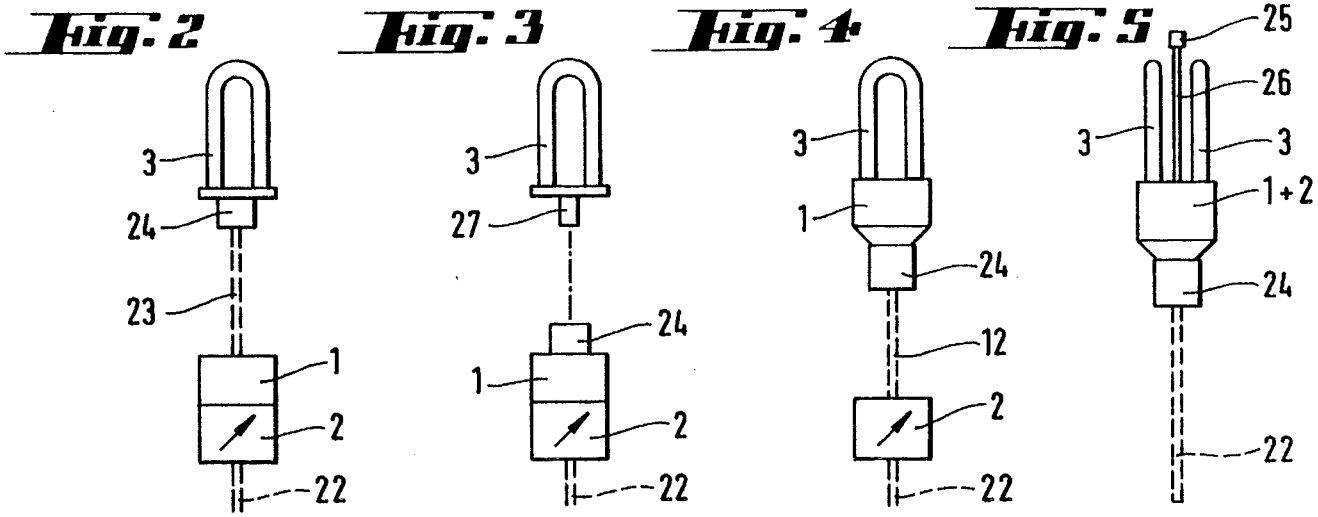
Fig. 5
Fig. 4
Fig. 3
Fig. 2

(-)

DIMMER CIRCUIT FOR GAS DISCHARGE LAMPS HAVING ELECTRONIC BALLASTS

BACKGROUND OF THE INVENTION

In recent years, the requirement for dimmers, that is to say for devices which permit the brightness of illumination bodies to be varied, has increased continuously. Conventional incandescent lamps and halogen lamps can be dimmed with a relatively low expenditure, and there is a large number of devices of this type on the market.

Dimming in the case of fluorescent tubes, especially in the case of compact lamps having electronic ballasts, has a somewhat more complicated configuration. For compact lamps there are still virtually no usable solutions on the market. It is the object of the invention to present a simple, operationally reliable and economical solution.

SUMMARY OF THE INVENTION

The solution according to the invention of a dimmer circuit is predominantly suitable for gas discharge lamps whose electronic ballast is equipped with a converter, which first transforms the input voltage by means of switching transistors into a high-frequency alternating voltage, which is fed indirectly or directly to the gas discharge lamp, a second converter circuit being connected upstream, according to the invention, the said converter circuit transforming the input voltage into a high-frequency alternating voltage and, after rectification, feeding it to the first converter. By means of the upstream second converter circuit it is achieved that the gas discharge lamp with its ballast is supplied with direct current and, by this means, dimming of the first converter circuit with the gas discharge lamp is possible by means of controlling the rectified output voltage via switching means which can be operated manually or by remote control.

In this arrangement it is particularly advantageous that the second converter circuit can be equipped in a known fashion with switching means for power factor correction, so that this type of dimming also fulfills future, more severe regulations with reference to harmonic content.

The stabilization, too, of the output voltage of the second converter is possible in a known way by means of simple switching means, so that the influence of mains voltage fluctuations on the first converter can be virtually completely eliminated.

According to the invention, it is furthermore proposed to provide in the second converter circuit switching means which, on switching on, first feed to the first converter a voltage which suffices for reliable firing of the gas discharge lamp and then, as a function of time, in accordance with a prescribed firing duration, control to the respective set dimming.

Such a measure, in order to achieve reliable firing of the gas discharge lamp, can also be implemented in the manner that, after switching on, a voltage is first fed to the first converter which suffices for reliable firing of the gas discharge lamp and, as a function of the firing process which has occurred or the current or voltage condition which then prevails, the previously set dimming takes place.

The simple and reliable influencing of the second converter circuit also permits the arrangement of temperature-dependent switching means which influence the magnitude of the output voltage and/or the firing conditions in such a way that, for example, low winter temperatures do not effect a loss of light or firing disturbances.

What is more, the arrangement of light-dependent switching means in the second converter circuit permits, according to the invention, a true dimmer switch to be implemented, which matches the brightness of the fluorescent lamp as a function of daylight or, respectively, switches it on or off.

A further security circuit comprises the second converter containing switching means which, during dimming, switch off the second converter and thus the entire power supply, as soon as the gas discharge lamp is extinguished, by which means it is avoided that, for example, the heating current of the electrodes continues to flow without light being emitted.

Such a security circuit can, according to the invention, also comprise arranging switching means in the second converter which, for example in the case of undershooting of the nominal power, the normal voltage or the normal current to less than 40%, switch off the second converter and hence the entire power supply is switched off.

The dimmer circuit according to the invention also has significant advantages in its spatial allocation. The second converter circuit can, for example, be integrated with the electronic ballast to form one unit.

What is more, a complete integration of the second converter circuit with the electronic ballast, which is connected in a fixed or detachable manner to the gas discharge lamp to form a compact lamp, brings especial advantages.

In this arrangement, according to the invention, the arrangement of manually actuated means for influencing the output voltage and thus the brightness in a simple way is possible.

With respect to the operation, apart from manual influencing of the second converter circuit, a control circuit, for example having touch sensors, also comes into consideration, the said control circuit, according to the invention, influencing the magnitude of the output voltage cyclically or in a preprogrammed manner, so that mechanically moving parts can thus be avoided completely.

Another solution according to the invention comprises achieving the influencing of the second converter circuit by means of control pulses which are triggered by brief interruption of the supply voltage.

BRIEF DESCRIPTION OF THE DRAWINGS

FIG. 1 is a schematic diagram of a dimmer circuit in accordance with a preferred embodiment of the present invention.

FIGS. 2–5 schematically illustrate alternative ways of embodying a dimmer circuit in accordance with the present invention.

DESCRIPTION OF THE PREFERRED EMBODIMENTS

Figures 6, 7, 8, 9, 10, 11:
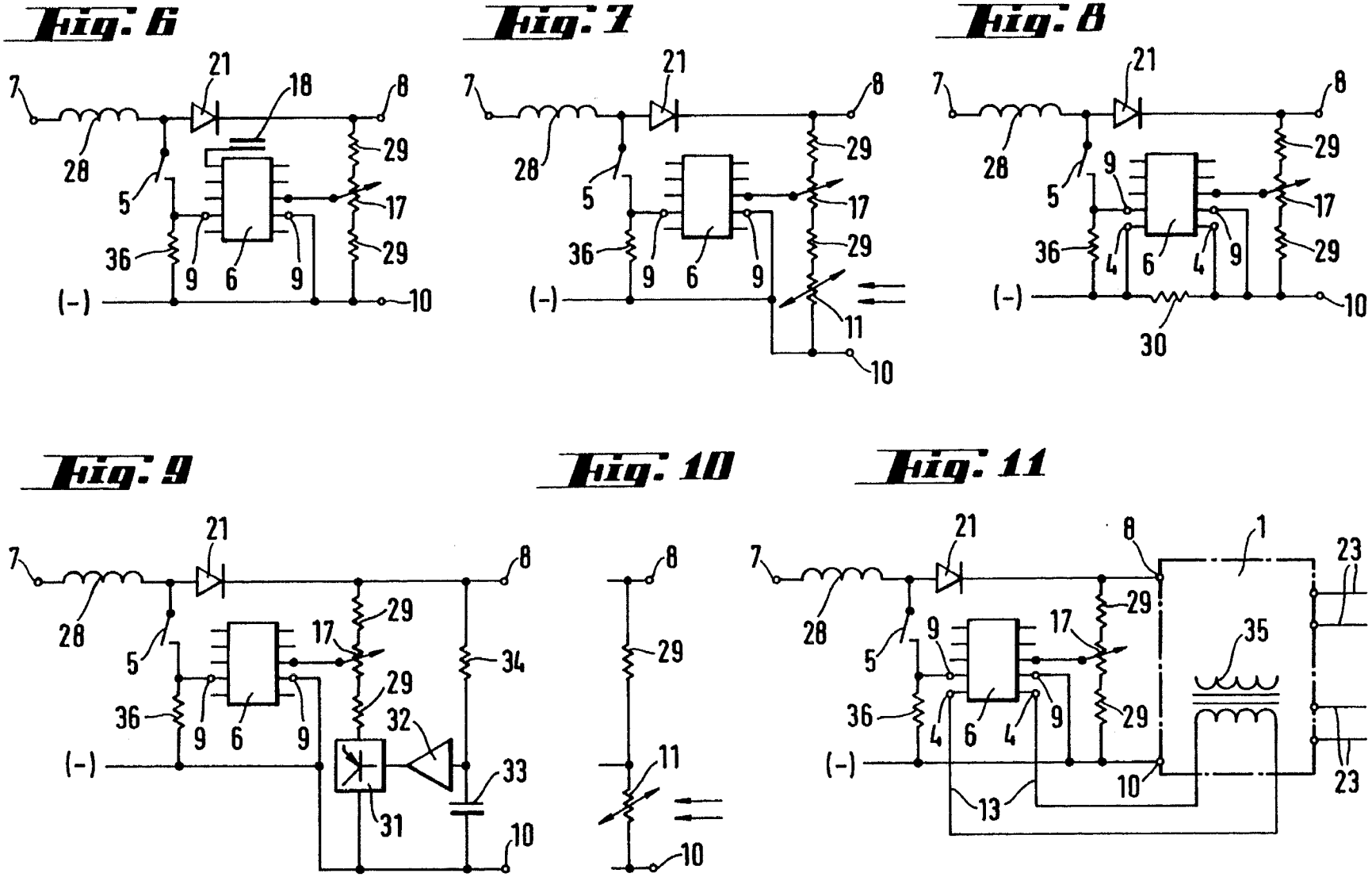
FIGS. 6–11 are schematic diagrams of various circuits used to achieve different control schemes in a dimmer circuit according to the present invention.

FIG. 1 shows in schematic form a dimmer circuit according to the invention for a gas discharge lamp (3), which has a converter (1) as electronic ballast, which generates from the supplied voltage $U_1$, via a rectifier (20) and switching transistors (5), a high-frequency alternating voltage, which is fed via connecting lines (23) to the heated electrodes (19) of the gas discharge lamp (3). These components can be combined to form one unit as a compact lamp (16).

Such a circuit is not readily suitable for controlling the brightness of the lamp by, for example, an otherwise common phase gating control.

According to the invention, such a compact lamp (16) now has a second converter circuit (2) connected upstream of it, which has, apart from the rectifier (20) and the switching transistors (5), a rectifier (21) at the output, so that a DC voltage is fed to the converter (1), which voltage does not impair the functioning of the converter (1). The controller (17) contained in the converter (2) and to be manually actuated permits the magnitude of the output voltage $U_1$ and thus the brightness of the gas discharge lamp (3) to be varied.

In order to fulfill the task which often occurs of controlling voltages, of stabilizing voltages or of removing harmonics (carrying out power factor correction), there is on the market a whole series of integrated circuits (6), which simplify the construction of a controlled converter (2) of this type (for example Siemens TDA 48xx).

For the functioning of the dimmer according to the invention, it is unimportant whether the controller (17) is integrated in the converter (2) or is arranged as an external remotely controllable switching means (14).

The arrangement of switching means for reducing harmonics (power factor correction) in the integrated circuit (6) has a particular significance for the invention, since compact lamps with electronic ballast commonly have a power factor of only 0.50 to 0.60. The losses thereby incurred are, in the case of a large number of such lamps, a serious disadvantage for the power supply utilities. In some countries, for example Australia, compact lamps without power factor correction may no longer be sold.

A dimmer according to the invention, which contains a power factor correction, solves this problem completely, since even each compact lamp having a poor power factor no longer loads the mains in an impermissible manner.

The integrated circuit (6) also makes possible an almost ideal stabilization of the respective output voltage $U_1$. This problem is of the greatest significance primarily in developing countries with strongly fluctuating mains voltages.

FIGS. 6 to 11 show in schematic form examples in which simple way all conceivable control problems can be solved.

Firstly, FIG. 6 shows the schematic construction of the dimmer, only the parts important for the control process being shown. Incidentally, like parts have like designations in FIGS. 1 to 11.

The mains voltage $U_2$ is first rectified via a rectifier circuit (20) not shown in FIG. 6, and fed via the terminal (7) and the choke (28) to the switching transistor (5), so that a high-frequency voltage is produced, having a frequency higher than about 20 kHz. This voltage is fed from the rectifier (21) as output voltage $U_1$ to the converter (1). Using the manually actuated controller (17), a varying control voltage is fed to the integrated circuit (6), which varies the magnitude of the output voltage $U_1$ as desired.

The control range of the manually actuated controller (17) can be matched to all requirements by means of matching resistors (29).

At the terminals (9)—(9), there takes place a current-dependent control of the voltage, which is finally transmitted at the output terminals (8) and (10) to the converter (1). The shunt (36) supplies the necessary control signals.

Instead of a manual adjustment, a touch sensor (18) can also be provided, which controls the output voltage $U_1$ cyclically or in a programmed manner in a known way, via the integrated circuit (6). All other known circuits having one or more keys or touch sensors are equally applicable according to the invention.

FIG. 7 shows, in principle, the same circuit but expanded by means of light-dependent switching means (11), which, for example, reduce the output voltage across the terminals (8) and (10) in the event of incident light and, vice versa, in the event of a lower incidence of light, feed a higher voltage to the converter (1), which results in a greater brightness of the fluorescent lamp (3).

By means of a circuit in accordance with FIG. 7, for example, the brightness of the gas discharge lamp (3) can be controlled as a function of the ambient light, or, in the extreme case, the gas discharge lamp (3) can be switched on when darkness falls. The manually actuated controller (17) can be omitted in such a case or allows a specific brightness to be preselected.

In FIG. 8 a circuit is specified which can prevent the extinguishing of the gas discharge lamp in the event of too severe dimming, but nevertheless a permanent residual current remains.

For this purpose, a current detector (30) is connected to the terminals (4), the said current detector (30) blocking the current flow in the integrated circuit (6) as soon as it undershoots a specific limit. Only after turning up the controller (17), as soon as a specific threshold value is exceeded, does the integrated circuit (6) release the current flow once more for renewed firing. A similar function is shown in FIG. 11, the information in this schematic example being provided to the terminals (4) of the integrated circuit by a current converter (35). This current converter (35) can, per se, be connected in at any desired point of the current flow, that is to say also, for example, –as shown –in the converter (1).

A further protective function is shown in FIG. 9. In this case, a transistor circuit (31) is arranged in series with the manually actuated controller (17), the said transistor circuit (31) being connected via an amplifier (32) to a timer circuit, comprising the resistor (34) and the capacitor (33). Using such a circuit, it can be achieved that initially on switching on, the dimmer effect of the manually set switch (17) is made ineffective and dimming takes place to the previously set brightness value only after a specific time delay, that is to say after the switching of the transistor circuit (31).

The circuit has the purpose of avoiding the case that, with too low a setting of the dimmed voltage, no firing of the gas discharge lamp (3) occurs, since the converter (1) would be fed with too low a voltage.

FIG. 10 shows how the same purpose can be fulfilled with similar means, namely in that instead of the timer circuit, comprising resistor (34) and capacitor (33), a light-dependent element (11) checks whether the gas discharge lamp (3) has actually fired. Only after a successful firing does this circuit release the transistor circuit (31), and dimming then takes place to the preset dimming value corresponding to the position of the controller (17). This circuit has the advantage that it can undertake similar functions, as shown in FIG. 8 or FIG. 11, since in the event of extinguishing of the gas discharge lamp, the transistor circuit (31) is likewise blocked.

Attention is particularly drawn to the fact that all schematically shown functions serve only for the better understanding of the concept of the invention, but the functions mentioned in the patent claims can also be achieved using similar equivalent electronic circuits of a known type. It is also possible to combine the individual functions so that, for example, both light-dependent elements and temperature-dependent elements can be provided which, for example in the case of low temperatures, automatically increase the operating voltage of the gas discharge lamp. This condition is particularly important, since the brightness and the functionality of gas discharge lamps are considerably affected detrimentally at low temperatures.

According to the invention, it is possible to construct and design a dimmer circuit of this type in various ways.

For example, FIG. 2 shows a gas discharge lamp (3) which is inserted into a mount (24) and connecting lines (23) [sic] run to a ballast which has a converter (1) integrated with a converter (2), the power lines (22) being connected to the converter (2).

FIG. 3 shows a further integration, in that converter (1), converter (2) and a mount (24) are connected to form one component, into which the lamp base (27) of the gas discharge lamp (3) can be plugged. This unit is likewise provided directly with the power line (22).

FIG. 4 shows another combination, in which the fluorescent lamp (3) is integrated with the converter (1) in the manner of known compact lamps, and inserted into a mount (24). In this example, the converter (2) is shown as a separate ballast which is connected to the mount (24) via a connecting line (12) and is likewise supplied with power via the power lines (22). This arrangement corresponds, for example, to the incorporation of the dimmer in a flush-mounted switch box.

Finally, it is also possible to integrate converters (1) and (2) with gas discharge lamps (3) and to insert them into a mount (24) which is connected directly to the mains via the power line (22). In such a case, as an example, the manually actuated control could be carried out via a controller axle (26) with a controller handle (25), a novel solution which is to be welcomed, especially for desk lamps or bedside lamps.

These representations FIG. 2 to FIG. 5 are also to be understood only as schematic indications and are in no way to be understood as limiting for the construction of such components.

A particular property of the circuit is that it is short-circuit-proof.

| Symbols for HIL 01/Dimmer circuit | |
|---|---|
| 1 | first converter circuit |
| 2 | second converter circuit |
| 3 | gas discharge lamp |
| 4 | terminals |
| 5 | switching transistors |
| 6 | integrated circuit |
| 7 | terminals |
| 8 | terminals |
| 9 | terminals |
| 10 | terminals |
| 11 | light-dependent or temperature-dependent switching means |
| 12 | connecting line |
| 13 | connecting line |
| 14 | external switching means |
| 15 | dimmable compact lamp |
| 16 | compact lamp |
| 17 | controller to be manually actuated |
| 18 | touch sensor |
| 19 | heated electrodes |
| 20 | rectifier |
| 21 | rectifier |
| 22 | power line |
| 23 | connecting line |

-continued

| Symbols for HIL 01/Dimmer circuit | |
|---|---|
| 24 | mount |
| 25 | manually actuable controller handle |
| 26 | controller axle |
| 27 | lamp base |
| 28 | induction coil |
| 29 | matching resistors |
| 30 | current detector |
| 31 | transistor circuit |
| 32 | amplifier |
| 33 | capacitor |
| 34 | charging rebistor |
| 35 | current converter |
| 36 | shunt |

I claim:

1. Dimmer circuit for gas discharge lamps with an electronic ballast comprising:

a first converter circuit which transforms an applied voltage by means of switching transistors into a first high-frequency alternating voltage which is fed indirectly or directly to the gas discharge lamp; and a second converter circuit connected upstream with respect to the first converter circuit, said second converter circuit being arranged so as to transform an input voltage into a second high-frequency alternating voltage and also being arranged so as to rectify said second high-frequency alternating voltage to produce a rectified output voltage which is fed to the first converter circuit as said applied voltage, said second converter circuit including switching means which, operated manually or by remote control, influence the magnitude of the rectified output voltage from the second converter circuit.

2. The dimmer circuit as claimed in claim 1, wherein the second converter circuit contains switching means for reducing harmonics to thus provide power factor correction.

3. The dimmer circuit as claimed in claim 1, wherein the second converter circuit contains switching means for stabilizing the rectified output voltage.

4. The dimmer circuit as claimed in claim 1, wherein the second converter circuit contains switching means which, after switching on, first feed to the first converter a firing voltage which suffices for reliable firing of the gas discharge lamp and then, with a time delay in accordance with a prescribed firing duration, control to a selected dimming.

5. The dimmer circuit as claimed in claim 1, wherein the second converter circuit contains light-dependent switching means which, after switching on, first feed to the first converter a firing voltage which suffices for reliable firing of the gas discharge lamp and which, after firing, control to a selected dimming.

6. The dimmer circuit as claimed in claim 1, wherein the second converter circuit contains temperature-dependent and/or light-dependent switching means, which influence at least one of the magnitude of the rectified output voltage and a firing duration.

7. The dimmer circuit as claimed in claim 1, wherein the second converter contains at least one transistor circuit having light-sensitive switching means which, during dimming, as soon as the gas discharge lamp is extinguished, switch off the second converter and thus an entire power supply.

8. The dimmer circuit as claimed in claim 1, wherein the second converter contains switching means which, at a predetermined dimming, switch off the second converter and thus an entire power supply.

9. The dimmer circuit as claimed in claim 1, wherein the second converter circuit is spatially separated from a compact lamp.

10. The dimmer circuit as claimed in claim 1, wherein the second converter circuit is integrated with a compact lamp to form one unit.

11. The dimmer circuit as claimed in claim 1, wherein the second converter circuit is integrated with the first converter circuit and is connected to a gas discharge lamp in a fixed or detachable manner as a dimmable compact lamp.

12. The dimmer circuit as claimed in claim 11, wherein there are arranged on the dimmable compact lamp means to be manually actuated for influencing the rectified output voltage of the second converter circuit.

13. The dimmer circuit as claimed in claim 1, wherein, for remote control, a control circuit having a touch sensor is present in the second converter circuit, which control circuit influences the magnitude of the rectified output voltage cyclically or in a programmed manner.

14. The dimmer circuit as claimed in claim 13, wherein brief interruptions of the supply voltage, which influence the magnitude of the rectified output voltage cyclically or in a programmed manner, serve as control pulses.

* * * * *